US007457095B2

(12) United States Patent
Maurer et al.

(10) Patent No.: US 7,457,095 B2
(45) Date of Patent: Nov. 25, 2008

(54) DEMAGNETIZING METHOD

(75) Inventors: Albert Maurer, Wabergstrasse 11, Grut (CH) CH-8624; Marek Rohner, Zurich (CH)

(73) Assignee: Albert Maurer, Grut (CH)

( * ) Notice: Subject to any disclaimer, the term of this patent is extended or adjusted under 35 U.S.C. 154(b) by 0 days.

(21) Appl. No.: 12/070,692

(22) Filed: Feb. 20, 2008

(65) Prior Publication Data

US 2008/0197950 A1 Aug. 21, 2008

(30) Foreign Application Priority Data

Feb. 21, 2007 (CH) ..... 0289/07

(51) Int. Cl.
*H01F 13/00* (2006.01)

(52) U.S. Cl. ..... 361/149

(58) Field of Classification Search ..... 361/149–151; 335/284

See application file for complete search history.

(56) References Cited

U.S. PATENT DOCUMENTS 3,895,270 A * 7/1975 Maddox ..... 361/149
4,384,313 A 5/1983 Steingroever et al.
7,196,894 B2 * 3/2007 Maurer et al. ..... 361/149
2007/0133142 A1 6/2007 Meyer

FOREIGN PATENT DOCUMENTS

DE 30 05 927 A1 9/1981
EP 1 796 113 A1 6/2007

* cited by examiner

*Primary Examiner*—Ramon M Barrera
(74) *Attorney, Agent, or Firm*—Weingarten, Schurgin, Gagnebin & Lebovici LLP

(57) ABSTRACT

A method is presented for demagnetizing ferromagnetic components in an alternating field of an externally excited electrical series resonant circuit. A supply voltage having an excitation frequency (f) is applied in parallel to a demagnetization coil having a no-load inductance of the series resonant circuit, because of which an alternating current (I) flows through the series resonant circuit (1), which generates a magnetic alternating field. In the event of suitable selection of the excitation frequency (f) in such a way that the product of the excitation frequency (f) in Hz multiplied by the no-load inductance (L0) in Henry is f*L0≧0,22 Hz*H, the excitation frequency is in an operating range (5) and the series resonant circuit (1) may be used without further regulation technology to demagnetize components which are led through the inner chamber of the demagnetization coil (2) and form a fill level. If the excitation frequency (f) is selected accordingly, continuous operation is possible, in which the resonant frequency ($f_R$) of the series resonant circuit (2) is not reached even at a high fill level.

11 Claims, 5 Drawing Sheets

DEMAGNETIZING METHOD

This application claims priority to Swiss application No. CH-00289/07 filed Feb. 21, 2007.

TECHNICAL AREA

The present invention describes a method for demagnetizing ferromagnetic components in a magnetic alternating field of an externally excited series resonant circuit having an associated resonant frequency, comprising at least one demagnetization coil having a no-load inductance, which is connected in series to at least one first capacitor having an associated capacitance and in parallel to a voltage source, a supply voltage having an adjustable excitation frequency and fixed voltage amplitude being able to be applied.

PRIOR ART

Elongate coils, through which the material to be demagnetized is continuously conveyed, are used for demagnetizing ferromagnetic parts. The coil is connected to an AC voltage of constant frequency and amplitude, which is typically drawn directly from the mains. The material to be demagnetized is subjected to an increasing magnetic flux of alternating direction upon entry into the coil, until a maximum of the field is reached in the coil center. The material is cyclically permeated by the magnetic field alternately. After reaching this maximum, the amplitude of the alternating magnetic field gradually decreases, which causes the demagnetization effect in a known way.

The magnetic field permeating the coil induces an electrical voltage therein, which counteracts the applied supply voltage. This feedback behaves proportionally to the applied frequency according to the law of magnetic induction. It is additionally a function of the mass of the ferromagnetic material in the coil. This influence is nonlinear, in that the relevant increase of the inductance is limited by the magnetic saturation in the affected material.

The coil accordingly represents a variable inductance, whose value is a function of the charging with the material to be demagnetized. Two problems are connected thereto, which the present invention is concerned with solving.

The first problem arises due to the inductance, which has a direct relationship to the function of the coil. To achieve a specific current corresponding to a specific strength of the magnetic field, the supply voltage of the coil must be significantly higher in accordance with the frequency than in the event of supply by direct current. The power delivered by the supplying source, referred to as apparent power in the terminology of alternating currents, is much higher than the effective active power, which is referred to as active power. The voltage source must therefore deliver a much higher power in regard to voltage and current proportional to the frequency than would be necessary in the event of direct current for generating a corresponding magnetic field.

For small demagnetization coils having an apparent power up to approximately 5 kVA, direct supply from mains voltage is typical. The consumption of idle current connected thereto is compensated for using known means as in other inductive consumers. For higher powers, the coil may be supplied via a converter at reduced frequency, for example, at 20 Hz. The demand for voltage and apparent power is thus reduced. Because the demagnetization procedure requires a specific number of oscillations for decay of the magnetic field, it lasts correspondingly longer at lower frequency. The reduction of the frequency as a measure for reducing the required apparent power thus also results in a correspondingly reduced throughput.

A second solution comprises supplementing the coil with a capacitor to form a series resonant circuit as shown in FIG. 2. The capacitor connected in series to the coil is dimensioned in such a way that resonance occurs at the supply frequency. The inductive voltage arising by the feedback of the magnetic field is applied by the capacitor. The supplying source only provides an active power corresponding to the ohmic resistance of the coil (as shown in FIG. 1). The power demand of the coil thus becomes independent of the frequency, which may now be selected exclusively in consideration of the demagnetization procedure itself. This solution may only be implemented at fixed frequency, however, if the inductance of the coil remains constant, which is not ensured upon charging with material. Therefore, this solution requires special measures for adapting the supply frequency.

The inductance of the coil, which is a function of the charging and the material to be demagnetized, represents the second problem. Upon supply with constant voltage and frequency, the absorbed current of the coil decreases as a function of its charging, which results in altered conditions of the demagnetization process. In practice, demagnetization coils supplied directly from the mains are thus only weakly exploited, i.e., with small material cross-sections in comparison to the coil size. On the other hand, a method is described in European Patent Application 05 027 030.5, which provides a supply via converter and series capacitor, the frequency automatically tracking the resonant frequency of the series resonant circuit. The differing inductance of the demagnetization coil is thus taken into consideration by automatic tracking of the frequency and both problems are solved, but at the cost of a significant outlay for the circuit.

DE3005927 uses the refined regulation technology so that the frequency of the supply voltage, which is applied to an resonant circuit having a capacitor and a demagnetization coil, is adjusted continuously tracked to the resonant frequency of the resonant circuit. These refinements are only possible through the improved regulation technology, the regulation to the resonant frequency resulting in the maximum possible current flux through the demagnetization coil and thus to maximally large magnetic alternating fields.

DESCRIPTION OF THE INVENTION

The present invention relates to a significantly simpler circuit in relation thereto, which on one hand covers the large demand for apparent power of the demagnetization coil and on the other hand takes its variable inductance into consideration in such a way that the reproducible conditions are provided for the demagnetization procedure, independently of the charging.

Through this method, without additional technical outlay in the form of control/regulating circuits or on/off sequences for filled/empty coils, a demagnetization coil may be operated at a fill level from 0 to nearly 100% under largely constant processing conditions. The magnetic flux of the demagnetization coil is thus exploited in the best possible way. The demagnetization coil may tightly enclose the material and may be kept relatively small in its dimensions. Optimal demagnetization in regard to energy efficiency thus results.

A further object of the present invention is to provide a failsafe and nearly maintenance-free method for demagnetization.

The features of claim 1 comprise a method which achieves the objects described above. Advantageous embodiments of the method according to the present invention arise from the dependent claims, whose features are explained in the following description with reference to the attached drawings.

BRIEF DESCRIPTION OF THE DRAWINGS

In the following, the present invention is described in connection with the drawings.

FIG. 1 shows the current/frequency characteristic, as well as the impedance/frequency characteristic of a series resonant circuit according to the prior art, while

DESCRIPTION

Figure 1:
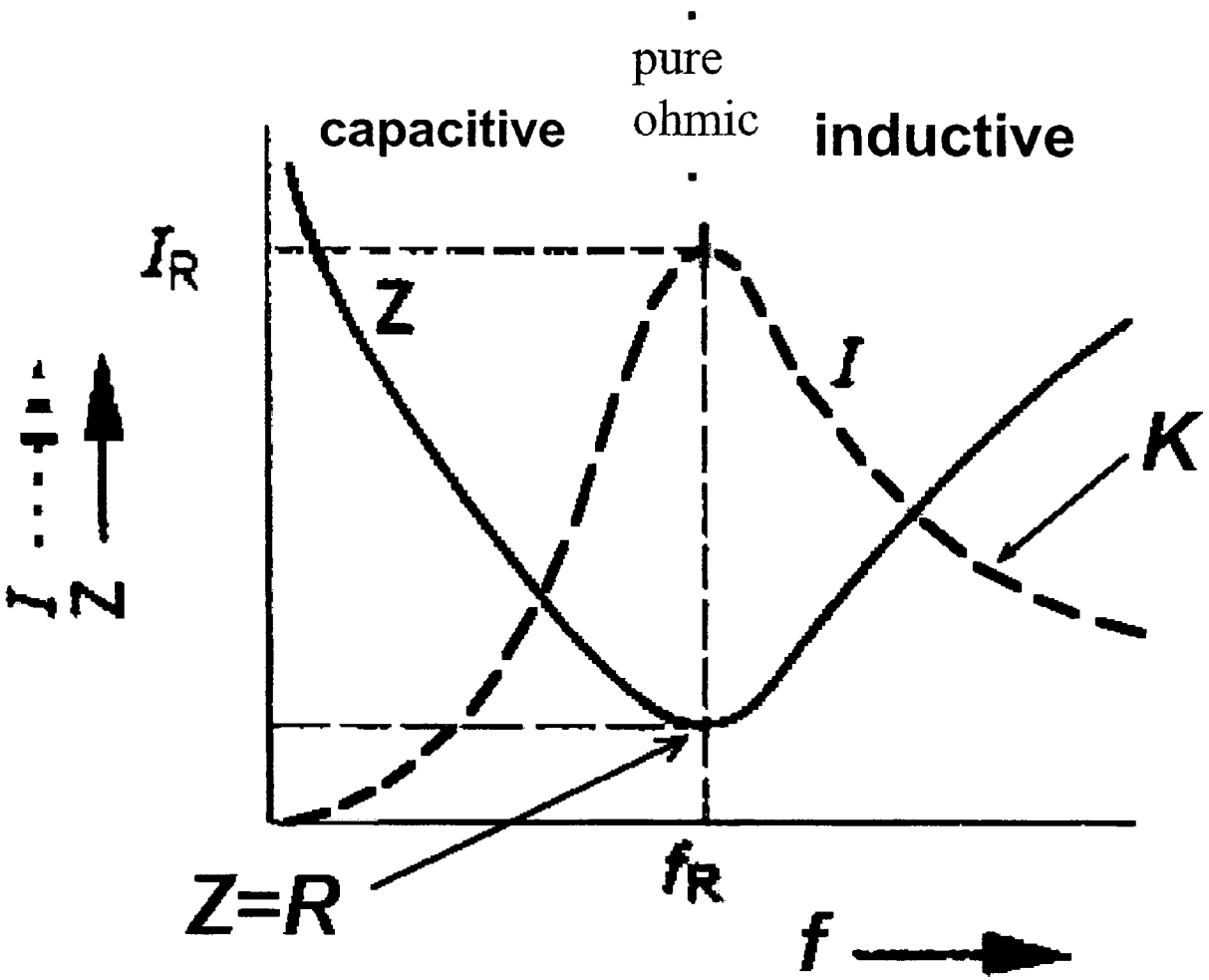

The demagnetization method presented here exploits the magnetic alternating field of a current-permeated demagnetization coil 2 having a no-load inductance L0, which is part of a series resonant circuit 1 and is connected in series to at least one first capacitor 4 having a capacitance C. The demagnetization coil 2 comprises multiple windings, which are advantageously wound as closely as possible, so that high magnetic field strengths are achievable, and may have a cylindrical or rectangular construction depending on the embodiment. The demagnetization coil 2 has a hollow inner chamber, through which the components to be demagnetized may be moved in the direction of the coil longitudinal axis. In further embodiments, the demagnetization coil 2 may be constructed from multiple separately wound demagnetization coils 2, which are connected to one another in such a way that the total number of the demagnetization coils 2 form a magnetic field. In these embodiments, the ferromagnetic components to be demagnetized are correspondingly guided through the inner chambers of the total number of the existing demagnetization coils 2.

The series resonant circuit 1 is known to have an impedance Z, which may be calculated from the ohmic resistance R of the components and supply lines, as well as from the total inductance L, which is determined from the no-load inductance L0 of the empty demagnetization coil 2 and additional inductances, and the total capacitance of the series resonant circuit 1, the capacitance C of the first capacitor 4 and additional capacitances providing a contribution. As usual, the total ohmic resistance of the series resonant circuit 1 is symbolically identified by the resistance R.

A voltage source 3, which delivers a constant AC voltage, the supply voltage U, having an adjustable excitation frequency f, is connected in parallel to the demagnetization coil 2 and thus to one pole of the demagnetization coil 2 and to one pole of the first capacitor 4. Because active regulation is not required for the present method, high requirements are not placed on the voltage source 3. The voltage source 3 must provide a constant peak-to-peak voltage amplitude and the excitation frequency f of the supply voltage must be freely adjustable to a constant value in a frequency range from approximately 1 Hz to 100 Hz to use the voltage source 3 for the desired demagnetization process at excitation frequencies f of 1 Hz to 100 Hz. Experiments have provided optimal results at excitation frequencies f of 2 Hz to 50 Hz.

FIG. 1 shows a known current/frequency curve K of a series resonant circuit 1, a flowing alternating current I being achieved depending on the selection of the excitation frequency f. The resonant frequency $f_R$, at which the flowing current I in the series resonant circuit 1 assumes a current maximum $I_R$, because the impedance reaches a minimum for $f=f_R$, is clearly recognizable. The resonant frequency $f_R$ is proportional to the inverse of the product of no-load inductance L0 multiplied by the capacitance C. The resonant frequency $f_R$ is known to be able to be estimated using this calculation guideline.

If components are led through the inner chamber of the demagnetization coil 2, the inner chamber of the demagnetization coil 2 is filled up to a certain fill level, so that the total inductance L, which is composed of the no-load inductance L0 of the empty demagnetization coil 2 and an auxiliary inductance L1 of the supply components, increases accordingly, from which a reduction of the resonant frequency $f_R$ of the series resonant circuit 1 results, which is visible in a shift of the current/frequency curve K. Because the inductance L1 of the supply components also changes during the demagnetization, this effect results in a dynamic shift of the resonant frequency $f_R$ during the demagnetization process.

While demagnetization devices used up to this point have regulated the excitation frequency f exactly and continuously to the varying resonant frequency $f_R$ to achieve the maximum possible current, i.e., the current maximum $I_R$ through the demagnetization coil 2, the method described here follows another path. The excitation frequency f is kept at a constant value below the resonant frequency $f_R$ in an operating range 5 during the entire demagnetization procedure.

The current maximum $I_R$ and thus the maximum magnetic field may not be achieved as long as the excitation frequency f is within the operating range 5. Experiments have shown that the maximum current $I_R$ arising in the demagnetization methods used up to this point is not absolutely necessary for good demagnetization results and sufficient saturation of the components may already be achieved at lower magnetic field strengths.

In the demagnetization method presented here, an excitation frequency f for a given demagnetization coil 2 having known no-load inductance L0 and at least one first capacitor 4 having known capacitance C is set in such a way that the size of the product of the excitation frequency f in Hz multiplied by the no-load inductance L0 in Henry is $f*L0 \geqq 0{,}22$ [Hz*H].

If the series resonant circuit is externally excited using a supply voltage U and an excitation frequency f which is within the operating range 5, so that f*L0 is greater than or equal to 0.22 [Hz*H], the possible alternating current amplitude I does not reach the maximum current $I_R$, even if the inner chamber of the demagnetization coil 2 is filled. The result is a stable current flux through the series oscillating current 1 in the operating range 5 of the excitation frequency f from FIG. 3 below the resonant frequency $f_R$ in the inductive range of the current/frequency curve from FIG. 1.

As long as an excitation frequency f was selected which, multiplied by the no-load inductance L0, results in a product $f*L0 \geqq 0{,}22$ [Hz*H], the value of the excitation frequency is in the operating range 5 and thus even if the inner chamber of the demagnetization coil 2 is filled up to 90°, it is still below the resonant frequency $f_R$, because of which the maximum current $I_R$ is not achieved even with maximum applied supply voltage U. Because the maximum current $I_R$ is not reached, the voltage source 3 on the series resonant circuit 1 is operated in the optimal operating point.

If the voltage amplitude at the voltage source 3 and the excitation frequency f of the supply voltage U were set to a desired value corresponding to the product f*L≧0,22 [Hz*H], the voltage source 3 operates in continuous operation and a constant AC voltage is applied to the series resonant circuit 1, which results in an alternating current I in the series resonant circuit 1, which generates an alternating magnetic field during the passage through the demagnetization coil 2. Except for tuning the excitation frequency f to the operating range 5 before beginning the demagnetization, no further adaptation of the series resonant circuit 1 is necessary, i.e., no active regulation and no change of the electronic components are necessary, because of which failsafe and nearly maintenance-free operation is possible.

If the series resonant circuit 1 is externally excited using the voltage source 3, the inner chamber of the demagnetization coil 2 is continuously filled up to a fill level of approximately 90%. For this purpose, ferromagnetic components to be demagnetized are introduced axially from one side into the demagnetization coil 2, or correspondingly into multiple demagnetization coils 2. After they have traversed the inner chamber, the components leave the demagnetization coil 2 again. The components may be guided individually once automatically lying on a conveyor device, or multiple times using an endless conveyor device, through the inner chamber of the at least one demagnetization coil 2. Manually performed supply of the components to be demagnetized is also possible.

During the demagnetization procedure, the magnetic field of the demagnetization coil 2 permeates the component more or less strongly depending on the wall thickness of the component. The elementary magnets in the interior of the component are alternately oriented corresponding to the external magnetic field.

Figure 4:
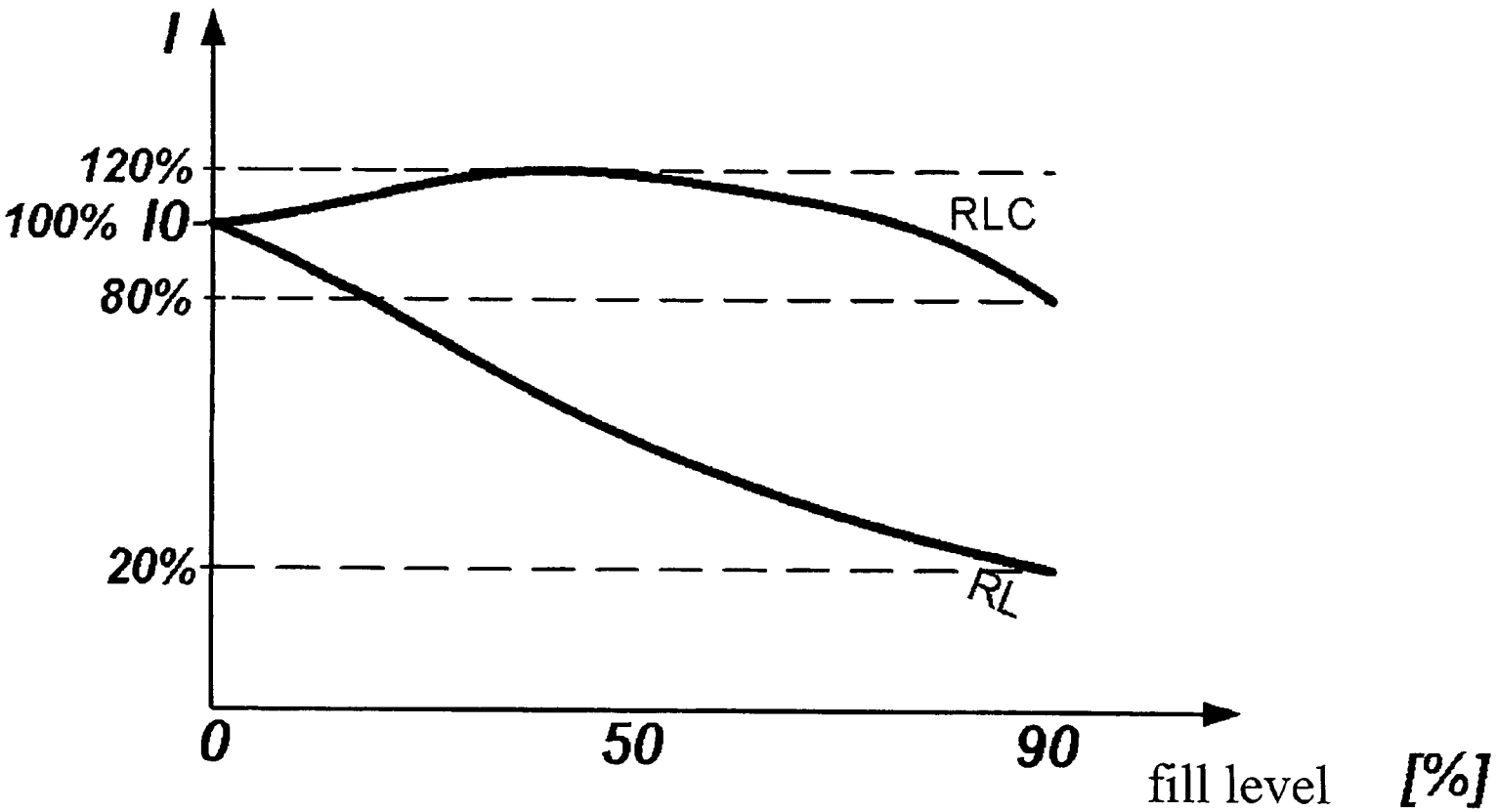
FIG. 4 shows achievable alternating current amplitudes in a series resonant circuit externally excited by a supply voltage, corresponding to the method according to the present invention, as well as the amplitude of the alternating current in a coil circuit, as a function of the fill level.

A current/fill level curve for a series resonant circuit 1, which is identified by RLC, is plotted in FIG. 4, which shows a maximum achievable alternating current amplitude at a fill level of approximately 50%. This rise may be explained by the shift of the resonance curve to the left upon increase of the total inductance L, by which the level of the current is increased. If the excitation frequency f is selected in accordance with f*L≧0,22 [Hz*H], the resonance is not achieved upon increase of the fill level. Because the auxiliary inductance L1 of the supplied components is continuously reduced by the demagnetization process, the resonance curve and/or the resonant frequency travel further to the right to higher frequencies.

In comparison to the series resonant circuit, the current/fill level curve RL of a coil circuit without capacitor is shown in comparison in FIG. 4. Because the increase of the total inductance L due to the components introduced into the inner chamber of the demagnetization coil 2 results in a strong increase of the resistance in accordance with the formula for the impedance of such a coil circuit, the flowing alternating current amplitude already sinks significantly at a fill level of 10%. These measurements clearly speak for the use of a series resonant circuit 1 having at least one first capacitor 4, which provides optimal demagnetization results in the range of a fill level from 10% to approximately 50%.

Figure 5:
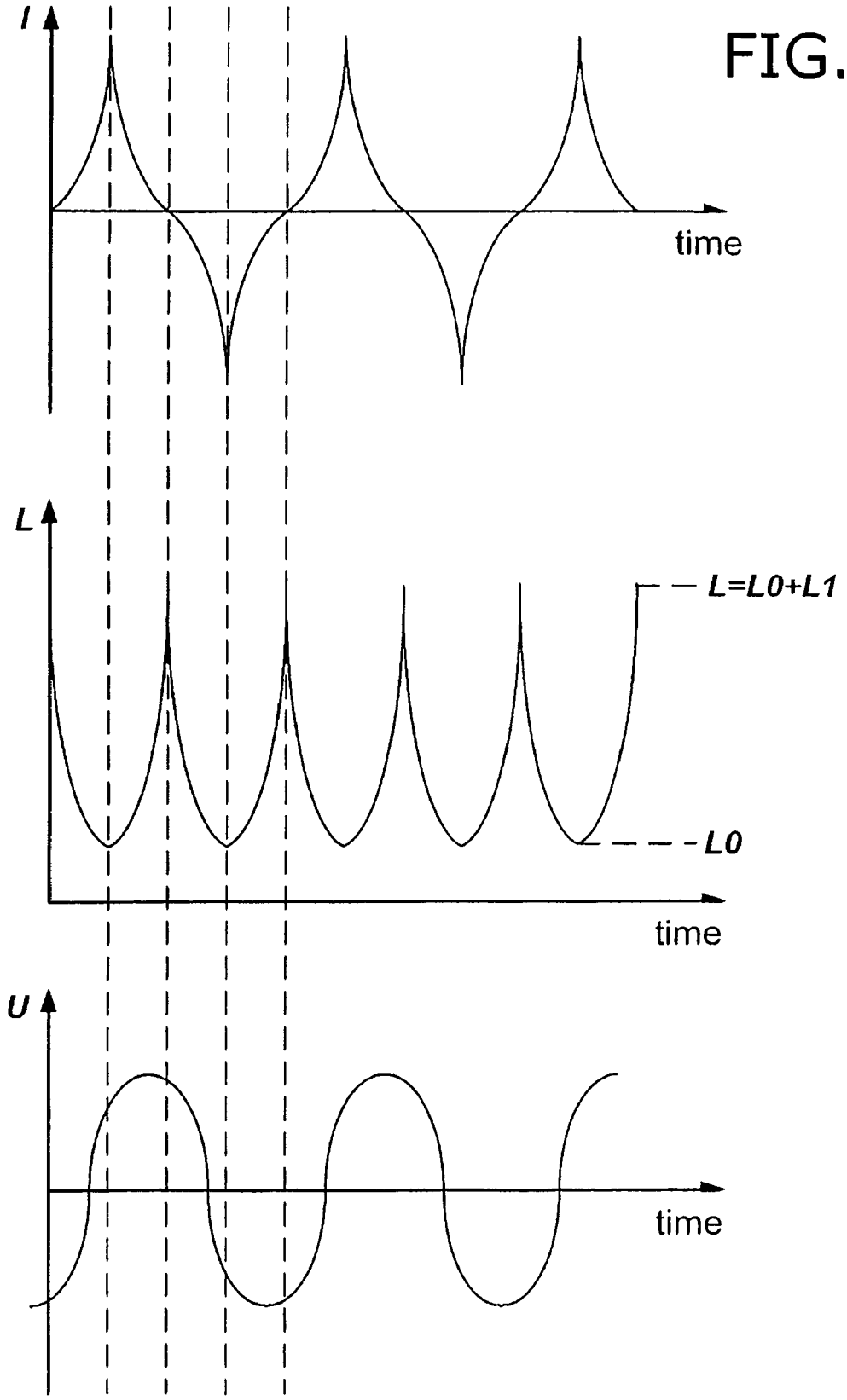
FIG. 5 shows the flowing alternating current, the associated total inductance change, and the variation of the supply voltage as a function of time in relation to one another.

Because of ferromagnetic properties, the components have an auxiliary inductance L1, which increases the total inductance L. During the continuous operation of the supply voltage U, an alternating current I results, which flows through the demagnetization coil 2, from which a magnetic field results, which permeates the components, by which the auxiliary inductance L1 is reduced. Depending on the dimension of the instantaneously flowing alternating current I, the total inductance L may be reduced to the minimum possible no-load inductance L0 in the event of maximum permeation of the ferromagnetic components. This periodic procedure is illustrated in FIG. 5 for a brief period of time, in which the components fill up the inner chamber of the demagnetization coil 2.

As soon as the component is removed from the demagnetization coil 2, the acting magnetic field is reduced, by which the residual magnetism of the component is reduced to zero.

Depending on their embodiment, the components may be led in a feed direction parallel to the longitudinal axis of one or more identically oriented demagnetization coils 2, the components being led through the demagnetization coils 2. Experiments have shown that a feed direction of the components which encloses an angle not equal to zero with a longitudinal axis of the at least one demagnetization coil 2 also leads to good demagnetization results.

Figure 2:
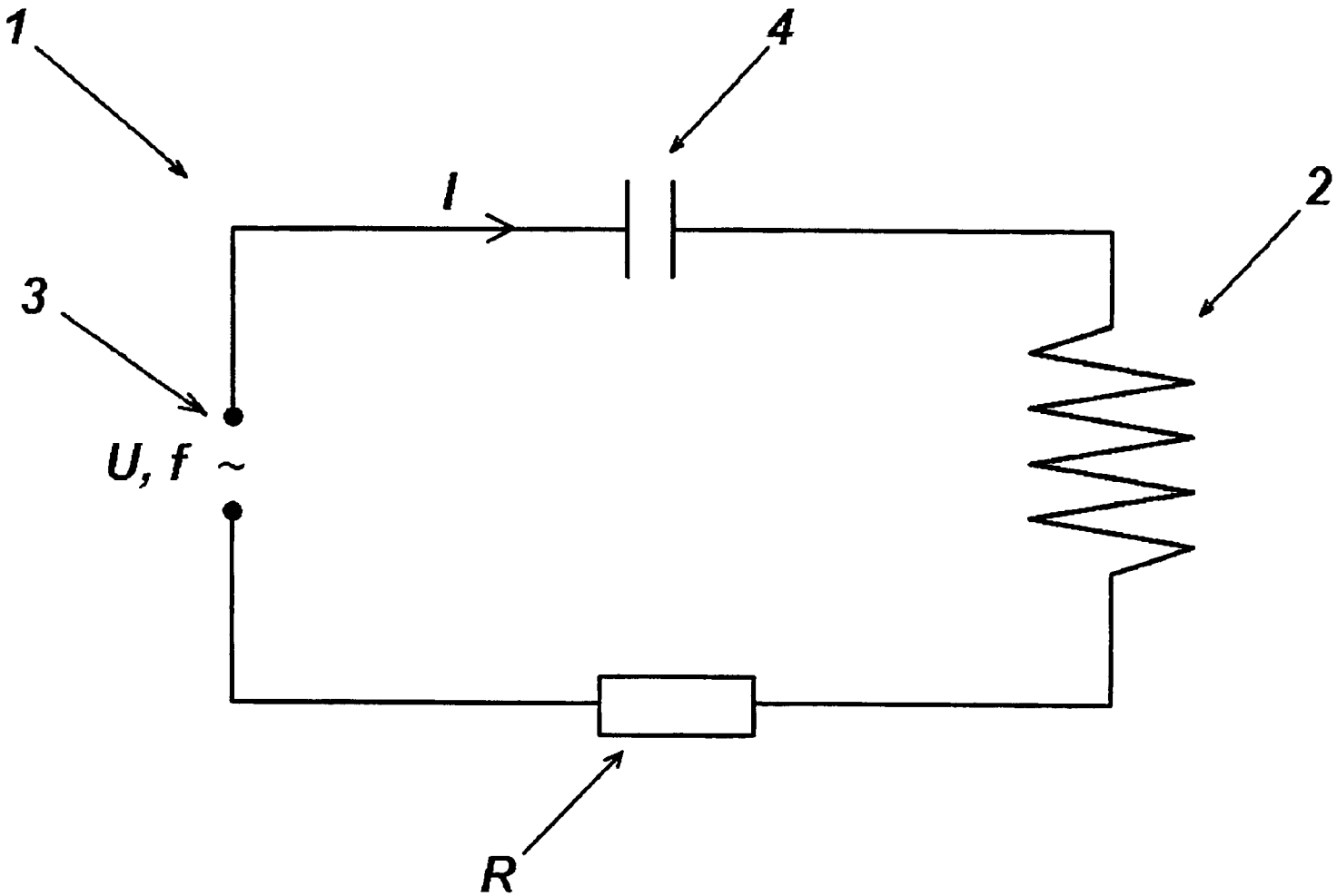
FIG. 2 represents a schematic diagram of a series resonant circuit for the method according to the present invention.
Figure 3:
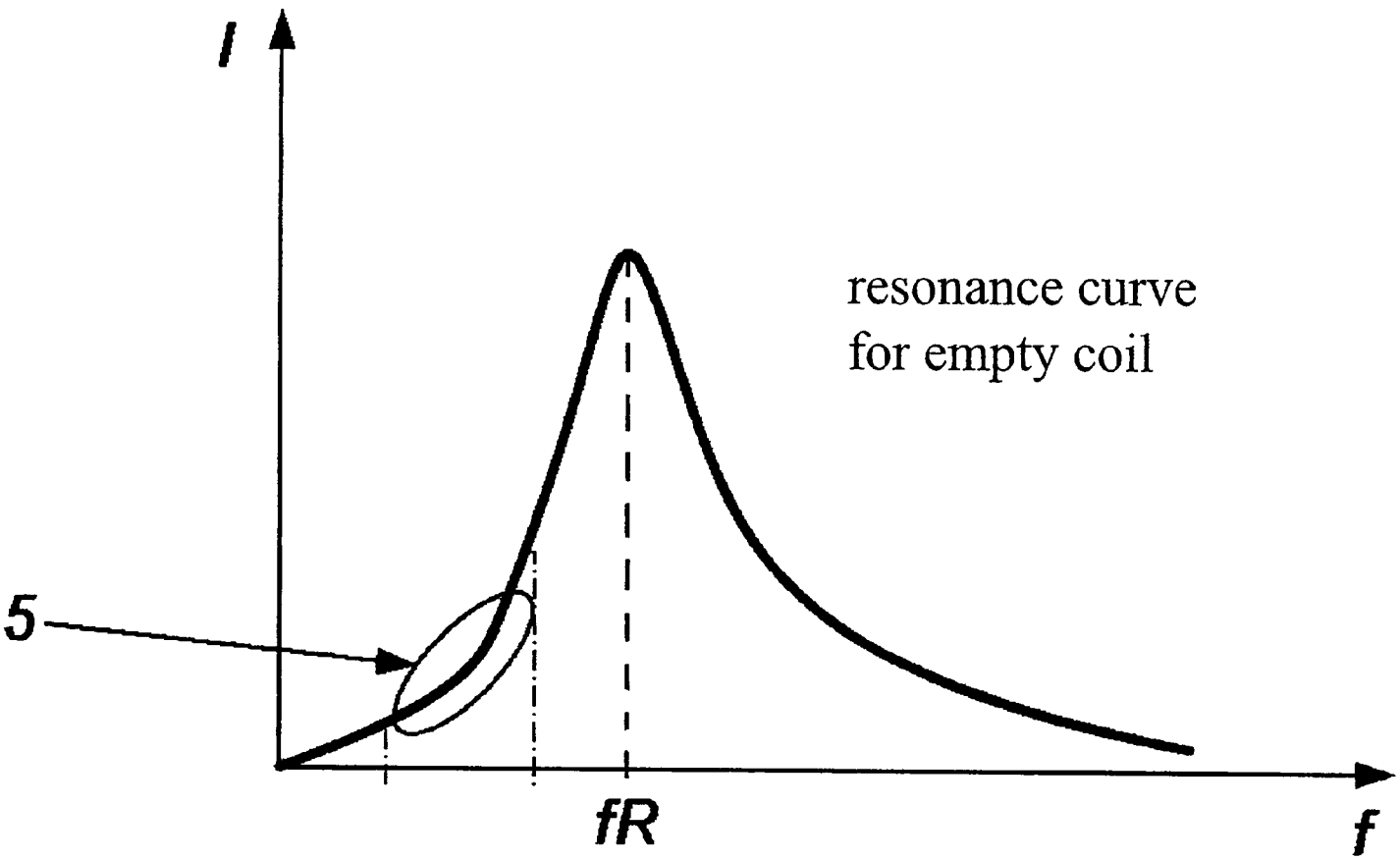
FIG. 3 illustrates the position of the operating range in the current/frequency curve of a series resonant circuit having empty demagnetization coil.

In the method according to the present invention, the demagnetization coil 2 is supplemented by a first capacitor 4 of specific capacitance C to form a series resonant circuit 1 (as shown in FIG. 2), and the circuit is continuously operated using a voltage source 3 of fixed supply voltage U and excitation frequency f. The parts to be demagnetized are conveyed individually, in groups, or in a continuous flow at a specific velocity through the demagnetization coil 2. The series resonant circuit 1 is (as shown in FIG. 3) equalized to the supplied excitation frequency f in such a way that its natural frequency or resonant frequency $f_R$ without charging is higher by a specific absolute value than the supplied excitation frequency f.

Using this particular adjustment as a feature of the present invention, the circuit may be operated on one hand at good efficiency, i.e., a low excess of apparent power, and on the other hand with conditions for the demagnetization process which are independent of the throughput of material. This is based on the interaction of the following effects. Voltage U and current I of the demagnetization coil 2 increase with its impingement by the material to be demagnetized in accordance with the curve of the apparent resistance of the series resonant circuit in the surroundings of the resonance point. The reason for this is the total inductance L, which increases with this impingement, and which causes a reduction of the natural frequency $f_R$ and thus an approach of the resonance point of the series resonant circuit 1 to the supplied excitation frequency f.

In contrast to powering at constant voltage, upon which the coil current decreases with increasing load by the material to be demagnetized, voltage and current rise with increasing load, up to approximately 50% fill level (as shown in FIG. 4). This rise is limited on one hand by the curve of the resonance curve itself, and on the other hand by the magnetic saturation of the introduced material. This second effect, which predominates in the event of stronger filling of the demagnetization coil 2 by the material to be demagnetized, simultaneously ensures a perfect demagnetization process having a minimum of residual magnetism.

If a demagnetization coil 2 is operated according to the method according to the present invention and filled with ferromagnetic material, alternating current I, inductance $L_0$, and supply voltage U assume the shapes shown in FIG. 5. The inductance $L_0$ corresponds to the inductance of the air coil. $L_1$ corresponds to the inductance increase as a result of the unsaturated ferromagnetic material.

In all cases in which the penetration depth of the magnetic field is sufficient at an excitation frequency f of 50 Hz, the demagnetization coil 2 may be supplied directly by a first capacitor 4 in series, if it is tuned to a natural frequency $f_R$ of the freely oscillating series resonant circuit 1 with non-impinged demagnetization coil 2, which is in the range of 70 Hz.

Experiments have shown that good demagnetization results are achieved if the quality Q of the demagnetization coil 2, which is calculated by the quotient of the no-load inductance of the empty demagnetization coil 2 having the unit Henry divided by the ohmic resistance R in the unit ohm of the series resonant circuit 1, is preferably in a range 0.04<Q<0.4 [H/Ohm]. If copper or aluminum is used as the coil material of the demagnetization coil 2, the quality Q is in a range from 0.005 to 0.4H/Ohm and preferably in a range from 0.005 to 0.2H/Ohm.

NUMERIC EXAMPLE

A classic RL configuration comprising a coil and AC voltage source connected in parallel: inductance of the coil is $L_0$=44 mH, ohmic resistance 0.7 ohm, operating voltage 130 VAC (effective value), and operating frequency 25 Hz. In the uncharged state, a current of 18.7 A flows through the coil and generates a corresponding magnetic field.

Upon filling with ferromagnetic material to ~7.5% fill level, the current and the corresponding magnetic field sink to 11.15 A (effective value). Upon filling with ferromagnetic material to ~82% fill level, the current and the corresponding magnetic field sink to 3.9 A (effective value). If, according to the present invention, a capacitor 4 having C=330 uF connected serially to the coil is used, the following values result: with uncharged coil of $L_0$=44 mH and 0.7 ohm and an operating voltage of 232 VAC (effective value) and 25 Hz, 18.7 A flow (effective value).

Upon filling with ferromagnetic material to ~7.5% fill level, the current and the corresponding magnetic field rise to 21.9 A (effective value).

Upon filling with ferromagnetic material to ~82% fill level, the current and the corresponding magnetic field sink to 16.1 A (effective value).

LIST OF REFERENCE NUMERALS

1 Series resonant circuit
- Z impedance of the resonant circuit
- $f_R$ resonant frequency
- R ohmic resistance
- $I_R$ current maximum, maximal current

2 demagnetization coil
- L0 no-load inductance of the empty demagnetization coil
- L1 auxiliary inductance of the supplied components
- L total inductance (L=L0+L1)
- K current/frequency curve

3 voltage source
- f excitation frequency of the supply voltage
- I alternating current
- U supply voltage

4 first capacitor
- C capacitance

5 operating range

RLC current/fill level curve for series resonant circuit 1

RL current/fill level curve of an externally excited coil circuit

The invention claimed is:

1. A method for demagnetizing ferromagnetic components in a magnetic alternating field of an externally excited electrical series resonant circuit having an associated resonant frequency ($f_R$), comprising at least one demagnetization coil having a no-load inductance (L0), which is connected in series to at least one first capacitor having an associated capacitance (C) and in parallel to a voltage source having a supply voltage (U) with an adjustable excitation frequency (f) and fixed voltage amplitude being applicable, characterized in that a) the excitation frequency (f) is fixed in such a way that the product of the excitation frequency (f) in Hz multiplied by the no-load inductance (L0) in Henry is f*L0 ≧0.22 Hz*H, by which the excitation frequency (f) is limited in an operating range below the resonant frequency ($f_R$), before b) the voltage source is put into operation at a constant voltage amplitude and the fixed excitation frequency (f) and c) the components to be demagnetized are moved in a continuous operation through the demagnetization coil, the components having to lie in a defined fill level range in the interior of the demagnetization coil.

2. The method according to claim 1, characterized in that the quality Q of the at least one demagnetization coil, with Q =$L_0$/R [H/Ohm], is preferably between 0.04 <Q <0.4.

3. The method according to claim 1, characterized in that the components are each moved into and out of the at leat one demagnetization coil in the direction parallel to the longitudinal axis of the at least one demagnetization coil.

4. The method according to claim 1, characterized in that the feed direction of the components encloses an angle not equal to zero with the longitudinal axis of the at least one demagnetization coil.

5. The method according to claim 1, characterized in that the excitation frequency (f) of the supply voltage (U) is in a frequency range from 1 Hz to 100 Hz.

6. The method according to claim 1, characterized in that the excitation frequency (f) of the supply voltage (U) is preferably in a frequency range from 2 Hz to 50 Hz.

7. The method according to claim 1, characterized in that the fill level of the demagnetization coil with the components to be demagnetized moved therethrough is greater than 10%.

8. The method according to claim 3, characterized in that the fill level of the demagnetization coil with the components to be demagnetized moved therethrough is preferably approximately equal to 50%.

9. The method according to claim 1, characterized in that the method is operated in continuous operation after fixing the excitation frequency (f), the supply voltage (U) being kept constant without regulation and manipulation.

10. The method according to claim 1, characterized in that the components to be demagnetized are led automatically and individually once using a conveyor device, or multiple times using an endless conveyor device through the inner chamber of the at least one demagnetization coil.

11. The method according to claim 1, characterized in that the components to be demagnetized are led manually through the inner chamber of the at least one demagnetization coil.

* * * * *